United States Patent [19]

Leupers

[11] 4,345,423

[45] Aug. 24, 1982

[54] YARN RESERVE DISC FOR A SPINDLE ASSEMBLY OF A TWO-FOR-ONE TWISTER TEXTILE YARN PROCESSING MACHINE

[75] Inventor: Wolfgang Leupers, Krefeld, Fed. Rep. of Germany

[73] Assignee: Palitex Project Company GmbH, Krefeld, Fed. Rep. of Germany

[21] Appl. No.: 169,447

[22] Filed: Jul. 16, 1980

[30] Foreign Application Priority Data

Aug. 2, 1979 [DE] Fed. Rep. of Germany ..... 2931369

[51] Int. Cl.[3] ..... D01H 7/86

[52] U.S. Cl. ..... 57/58.84; 57/303

[58] Field of Search ..... 57/58.49, 58.83, 58.84, 57/58.86, 300, 303

[56] References Cited

U.S. PATENT DOCUMENTS

| | | | |
|---|---|---|---|
| 2,025,460 | 12/1935 | Lenk | 57/58.84 |
| 2,156,330 | 5/1939 | Bochmann | 57/58.84 |
| 2,523,859 | 9/1950 | Bradish | 57/303 |
| 2,693,074 | 11/1954 | Bochmann | 57/58.83 |
| 2,715,811 | 8/1955 | Kellogg | 57/58.84 |
| 2,731,787 | 1/1956 | Marsh | 57/58.83 |
| 2,747,359 | 5/1956 | Keefe, Jr. | 57/303 X |
| 2,855,748 | 10/1958 | Baumgarten et al. | 57/303 X |

FOREIGN PATENT DOCUMENTS

| | | |
|---|---|---|
| 2128486 | 12/1972 | Fed. Rep. of Germany . |
| 682391 | 11/1952 | United Kingdom . |
| 913697 | 12/1962 | United Kingdom . |
| 1418107 | 12/1975 | United Kingdom . |
| 1527487 | 10/1978 | United Kingdom . |
| 1543548 | 3/1979 | United Kingdom . |

*Primary Examiner*—John Petrakes

*Attorney, Agent, or Firm*—Bell, Seltzer, Park & Gibson

[57] ABSTRACT

An improved yarn reserve disc having an annular rim of a radial length of at least 7 mm extending radially outwardly from a lower portion of an outer, circumferential, yarn storage surface thereon in a spindle assembly of a two-for-one twister textile yarn processing machine. The annular rim prevents coils of yarn wrapped around such yarn reserve disc, upon breakage of the yarn during processing by the spindle assembly, from slipping down off of the yarn storage disc to interfere with subsequent driving of the spindle assembly.

2 Claims, 1 Drawing Figure

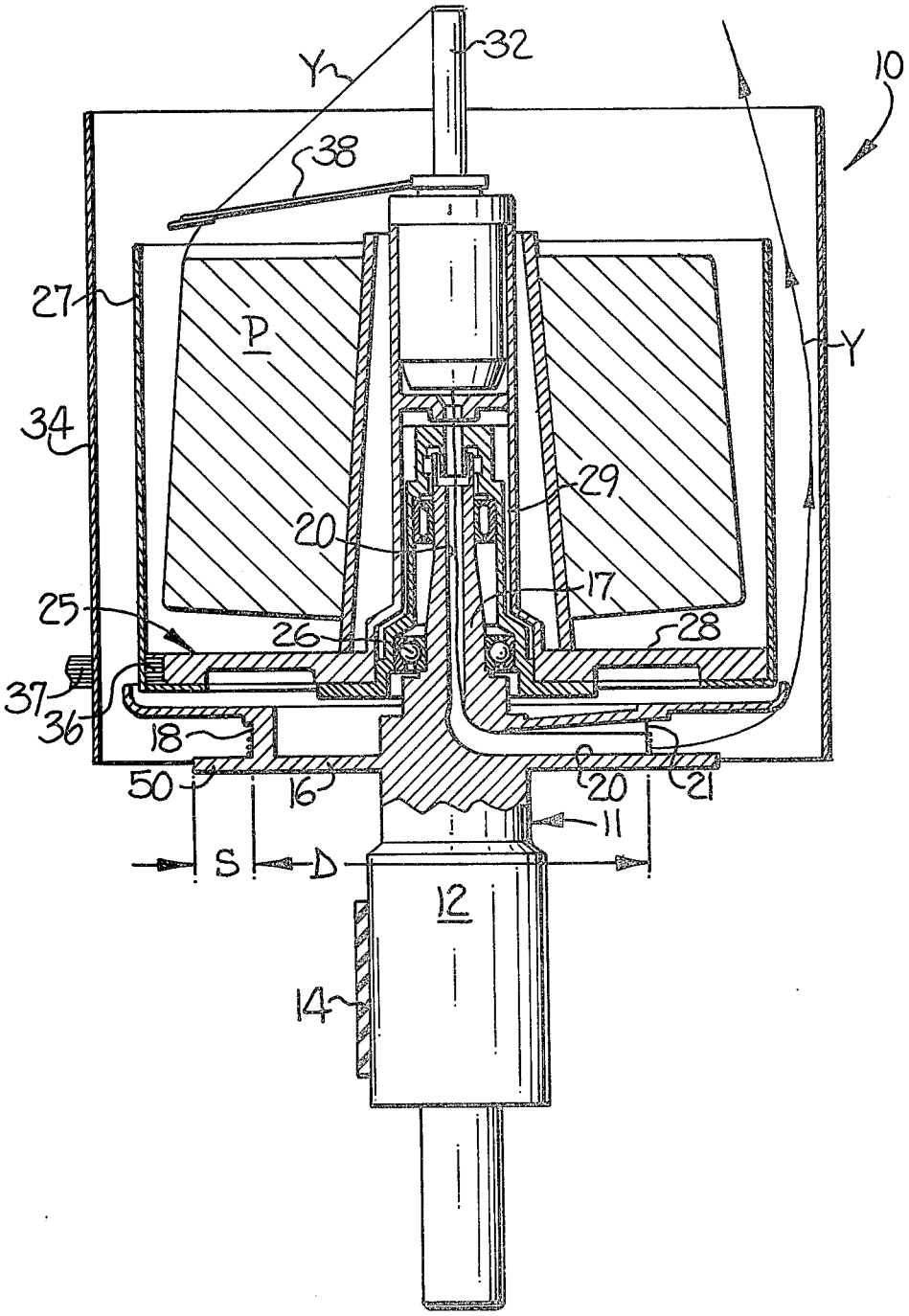
32
Y
10
38
27
P
Y
34
29
20
17
25
26
28
37
36
18
50
16
20
21
11
S
D
12
14

YARN RESERVE DISC FOR A SPINDLE ASSEMBLY OF A TWO-FOR-ONE TWISTER TEXTILE YARN PROCESSING MACHINE

FIELD OF THE INVENTION

This invention relates to an improved construction of a yarn reserve disc for a spindle assembly of a two-for-one twister textile yarn processing machine, which substantially prevents coils of yarn collected around such yarn reserve disc, particularly upon breakage of the yarn during processing by the spindle assembly, from slipping down off of the yarn storage disc to interfere with subsequent driving of the spindle assembly.

BACKGROUND OF THE INVENTION

Spindle assemblies of two-for-one twister textile yarn processing machines conventionally have a rotatably driven rotor mechanism including a driven whorl, a yarn reserve disc positioned above the whorl and having an outer, circumferential, yarn storage surface of predetermined diameter, a hollow axle extending axially from and above the yarn reserve disc, and a generally L-shaped yarn passageway extending axially through the hollow axle and partially through the yarn reserve disc and then radially through the yarn reserve disc and having an exit aperture in the storage surface. During processing of yarn in such spindle assembly of a two-for-one twister textile yarn processing machine, yarn is withdrawn from a supply package and is passed through the yarn passageway of the rotor mechanism and exits therefrom at the yarn storage surface where several wraps or coils of yarn may be taken-up on the yarn storage surface prior to further passage of the yarn through the spindle assembly of the machine for processing in a well-known manner.

In the event of yarn breakage during operation of the yarn processing machine, rotation of the rotor mechanism is stopped for piecing-up of the yarn. Unfortunately, yarn continues to be withdrawn from the supply package and wrapped or coiled around the yarn storage surface of the yarn reserve disc until the rotor mechanism has been completely stopped, due particularly to centrifugal force which acts on the yarn emerging radially from the yarn passageway through the yarn reserve disc.

Conventionally, these yarn reserve discs have a short annular rim extending radially outwardly from a lower portion of the yarn storage surface which is the result of the machining process utilized in constructing the yarn reserve disc, i.e. machining of a cylindrical workpiece to have an uninterrupted outer circumferential yarn storage surface of predetermined diameter. This resulting annular rim is an incidental resulting feature rather than a component provided for any specific purpose.

As a result of the phenomenon described above with respect to yarn breakage and further wrapping or coiling of yarn around the yarn reserve disc during stopping of the rotor mechanism, a problem often occurs of the coils of yarn slipping down off of the yarn storage surface of the yarn reserve disc into an area occupied by the driven whorl. If this results, subsequent driving of the rotor mechanism of the spindle assembly through the whorl is hampered.

It has been determined that the annular rim at the lower portion of the yarn storage surface of the yarn reserve disc, incidentally provided as a result of machining, will not sufficiently prevent the yarn coils from slipping off of the yarn storage surface and, therefore, does not overcome this problem.

Specific attempts to overcome this problem have been primarily directed to providing thread clamping devices which, in the event of yarn breakage, are intended to swing across the path of the yarn between the supply package and entry of the yarn into the yarn passageway through the spindle assembly to trap the yarn at this point. For reasons of expense, such mechanisms are predominantly of a mechanical nature. The prevailing conditions, such as dust, lint and lack of care in operation are often very unfavorable and the reliability of these clamping mechanisms suffer for these reasons and quite frequently are inoperable. When this results, the problem described above still exists.

SUMMARY OF THE INVENTION

With the foregoing in mind, it is an object of the present invention to provide an improved yarn reserve disc which substantially prevents slipping of coils of yarn from the yarn storage surface thereon, collected thereon particularly upon breakage of the yarn during processing by the spindle assembly, down into the area of the driven whorl of the rotor mechanism to thus prevent interference with proper subsequent rotation of the rotor mechanism.

This object is achieved in accordance with the present invention by providing an improvement to the yarn reserve disc of an annular rim extending radially outwardly from a lower portion of the yarn storage surface of the yarn reserve disc and having a radial length of at least 7 mm.

BRIEF DESCRIPTION OF THE DRAWINGS

The object and some of the advantages of this invention having been stated, other advantages and specific details of this invention will become apparent as the description proceeds when taken in conjunction with the accompanying drawing, in which The drawing is a cross-sectional elevational view of a portion of one spindle assembly of a two-for-one twister textile yarn processing machine utilizing the improved yarn reserve disc of this invention.

DESCRIPTION OF THE ILLUSTRATED EMBODIMENT

Referring now to the drawing, there is illustrated therein a portion of a single spindle assembly station, generally indicated at 10, of a two-for-one twister textile yarn processing machine. It is to be understood that a plurality of these spindle assembly stations 10 are provided in side-by-side relationship in two full rows along the outside of the machine. A full illustration and description of the entire two-for-one twister textile yarn processing machine is not given herein and is not believed to be necessary for an understanding of the present invention, the operation and complete structure of such a two-for-one twister being well understood by those with ordinary skill in the art.

Generally, each spindle assembly station 10 comprises a rotatably driven rotor mechanism, generally indicated at 11, which is suitably rotatably mounted on a portion of the twister frame (not shown) and includes a whorl 12 secured thereto or integral therewith and which is rotated by a continuous tangential drive belt 14 in a manner well understood by those with ordinary skill in the art. The rotor mechanism 11 further includes a horizontally-extending yarn reserve disc 16 secured thereto or integral therewith and positioned above the whorl 12. The yarn reserve disc 16 has an outer, circumferential, yarn storage surface 18 of predetermined diameter, indicated in the drawing by D. The rotor mechanism 11 further includes a generally vertically-extending hollow axle 17 secured thereto or integral therewith which extends axially from and above the yarn reserve disc 16. A generally L-shaped yarn passageway 20 extends axially through the hollow axle 17 and partially through the yarn reserve disc 16 and then radially through the yarn reserve disc 16 to an exit aperture 21 in the yarn storage surface 18.

The spindle assembly 10 further includes a stationary carrier mechanism, generally indicated at 25, for supporting and carrying a hollow supply package P of yarn Y. The carrier mechanism 25 is mounted on the rotor mechanism 11 by bearings 26 so that the rotor mechanism 11 may rotate relative to the carrier mechanism 25. The carrier mechanism 25 includes a basket device 27 which surrounds the package P, a disc-shaped bottom portion 28 for supporting the hollow yarn supply package P and a hollow tubular hub portion 29 extending upwardly into the hollow yarn supply package P for stabilizing the yarn supply package P.

A yarn entry tube 32 extends into the upper end of the spindle assembly and includes an axially-extending yarn passageway therethrough which communicates with the yarn passageway 20 for receiving and allowing passage of the yarn Y through the spindle assembly, in the manner illustrated in the drawing. The spindle assembly 10 further includes a balloon limitor 34 surrounding the basket 27 so as to contain a balloon of yarn Y formed around the outside of the basket 27. In order to maintain the yarn package carrier mechanism 25 stationary during rotation of the rotor mechanism 11, there may be provided magnets 36 carried by the bottom portion 28 and cooperating with magnets 37 carried by the stationary balloon limitor 34 to prevent rotation of the carrier mechanism 25.

The spindle assembly 10 further includes a flier mechanism 38 mounted on the yarn entry tube 32 for free rotation about the axis of the spindle assembly 10. There is further provided a take-up mechanism (not shown) including a yarn take-up or package roll upon which the yarn Y is wound after being processed by the spindle assembly station 10. The take-up mechanism is conventional in a two-for-one twister textile yarn processing machine and an illustration thereof and further explanation is not believed necessary for a full understanding of this invention.

With the above-described mechanisms of the spindle assembly 10, the yarn Y passes from the package P, through the rotating flier mechanism 38, and into the passageway of the yarn entry tube 32. The yarn Y then passes downwardly through the yarn passageway 20 of the rotor mechanism and emerges from the yarn reserve disc 16 at the exit aperture 21 in the yarn storage surface 18 where several wraps or coils of yarn may be taken up around the yarn storage surface 18 of the yarn reserve disc 16. The yarn Y then passes upwardly between the basket 27 and the balloon limitor 34 and forms a rotating balloon of yarn Y which is contained by the balloon limitor 34. The yarn Y then passes upwardly to the take-up mechanism (not shown) to complete its travel through the respective spindle assembly station 10. As is well understood by those with ordinary skill in the art, a two-for-one twist is inserted into the yarn during the abovenoted path of travel.

In order to prevent coils of yarn Y from slipping down off the yarn storage surface 18 of the yarn reserve disc 16, particularly those coils of yarn Y formed thereon upon breakage of the yarn Y during yarn processing and stopping of the rotor mechanism 11, the improvement is provided in accordance with this invention to the yarn reserve disc 16 of an annular rim 50 extending radially outwardly from a lower portion of the yarn storage surface 18 of the yarn reserve disc 16. This annular rim 50 has a radial length S, which is the additional length of radius beyond the radius of the yarn reserve disc 16, of at least 7 mm. This radial length S for the annular rim of 7 mm applies, for example, where the nominal diameter D of the yarn storage surface 18 of the yarn reserve disc 16 is 50 mm, with the radial length S preferably increasing to 14 mm for a yarn storage surface 18 of a yarn reserve disc 16 having a nominal diameter D of 200 mm. In other words, with a yarn storage surface 18 of a yarn reserve disc 16 having a diameter D of 50 mm, the outside diameter of the annular rim would be 64 mm; whereas, with a yarn storage surface 18 of a yarn reserve disc 16 having a nominal diameter D of 200 mm, the outside diameter of the annular rim would be 228 mm.

It has been established by means of deliberately provoked yarn breakage in a spindle assembly 10 of a two-for-one twister textile yarn processing machine that slippage of yarn coils from the yarn storage surface 18 of a yarn reserve disc 16 may be substantially prevented when the radial length S of the annular rim 50 comprises the following mathematical relationship:

$$S/D \geqq \sqrt{Do/D}\ ;$$

where S=the radial length of said annular rim, D=the nominal diameter of said yarn storage surface of said reserve disc, and Do=an auxiliary quantity of 1 mm.

Accordingly, with this described improved yarn reserve disc 16 in a spindle assembly 10 of a two-for-one twister textile yarn processing machine, wherein an annular rim 50 is provided of the above-defined particular radial length S, slippage of coils of yarn Y from the yarn storage surface 18 of the yarn reserve disc 16 down into the region occupied by the whorl 12, which would interfere with proper subsequent rotation of the rotor mechanism 11, will be prevented to the greatest extent possible.

In the drawing and specification there has been set forth a preferred embodiment of the invention, and although specific terms are employed, they are used in a generic and descriptive sense only and not for purposes of limitation.

What is claimed is:

1. In a spindle assembly of a two-for-one twister textile yarn processing machine having a rotatably driven rotor mechanism including a driven whorl, a yarn reserve disc positioned above said whorl and having an outer, circumferential yarn storage surface of predetermined diameter, a hollow axle extending axially from and above said reserve disc, and a generally L-shaped yarn passageway extending axially through said hollow axle and partially through said yarn reserve disc and then radially through said yarn reserve disc and having an exit aperture in said yarn storage surface; the improvement to said yarn reserve disc of means for preventing coils of yarn collected around said yarn storage surface, particularly upon breakage of the yarn during processing by said spindle assembly, from slipping down off said yarn storage surface onto said whorl which would interfere with proper rotation of said rotor mechanism, said means comprising an annular rim extending radially outwardly from a lower portion of said yarn storage surface of said yarn reserve disc and having a radial length comprising the relationship:

$$S/D \geqq \sqrt{Do/D}\ ;$$

where S=the radial length of said annular rim, D=the nominal diameter of said yarn storage surface of said reserve disc, and Do=an auxiliary dimension of 1 mm.

2. In a spindle assembly, as set forth in claim 1, in which said radial length of said annular rim comprises at least 7 mm.

* * * * *

UNITED STATES PATENT AND TRADEMARK OFFICE

CERTIFICATE OF CORRECTION

PATENT NO. : 4,345,423

DATED : August 24, 1982

INVENTOR(S) : Wolfgang Leupers

It is certified that error appears in the above-identified patent and that said Letters Patent are hereby corrected as shown below:

Column 4, line 2, "abovenoted" should be --above-noted--.

Column 4, line 64, after "said" insert --yarn--.

Signed and Sealed this

Sixteenth Day of November 1982

[SEAL]

*Attest:*

GERALD J. MOSSINGHOFF

*Attesting Officer*

*Commissioner of Patents and Trademarks*